United States Patent [19]

Beach et al.

[11] 4,334,966

[45] Jun. 15, 1982

[54] METHOD OF COPPER PLATING GRAVURE CYLINDERS

[75] Inventors: Sidney C. Beach, Parma; C. Richard Frisby, Strongsville, both of Ohio

[73] Assignee: McGean Chemical Company, Inc., Cleveland, Ohio

[21] Appl. No.: 265,143

[22] Filed: May 19, 1981

[51] Int. Cl.[3] ..... C25D 3/38; C25D 7/00

[52] U.S. Cl. ..... 204/25; 204/52 R

[58] Field of Search ..... 204/25, 52 R

[56] References Cited

U.S. PATENT DOCUMENTS

| | | | |
|---|---|---|---|
| 2,127,824 | 8/1938 | Leuchter | 204/25 |
| 2,424,887 | 7/1947 | Henricks | 204/52 R |
| 3,328,273 | 6/1967 | Creutz | 204/52 R |

*Primary Examiner*—T. Tufariello

*Attorney, Agent, or Firm*—Fay & Sharpe

[57] ABSTRACT

A method is provided for depositing on a gravure roll a layer of copper especially adapted to receive electronic engraving comprising the steps of placing a gravure roll in an electroplating bath comprising from about 150 to about 225 grams/liter of copper sulfate from about 35 to about 90 grams/liter of sulfuric acid, from about 1 to about 15 grams/liter of a polyether having a molecular weight from about 4,000 to about 10,000, from about 0.3 to about 3.0 milligrams/liter of 1-lower alkyl-2-mercapto imidazole, and from about 1 to about 100 milligrams/liter of a sulfonated, sulfurized benzene compound; and passing electrical current through the bath to deposit copper on said roll.

10 Claims, No Drawings

METHOD OF COPPER PLATING GRAVURE CYLINDERS

BACKGROUND OF THE INVENTION

This invention relates to a method of applying to a gravure cylinder a plating of copper especially adapted to receive electronic engraving. In this form of engraving a diamond tip stylus is forced against a copper outer layer to make an ink-receiving impression.

Copper plating applied to gravure cylinders with sufficient leveling tends to have an amorphous grain structure. Such a structure, because it lacks the requisite hardness or perhaps because of its amorphous nature, is not suitable for electronic engraving. According to an article published in Gravure by Ettl and Kolbinger, it is believed that exceptional hardness is required for successful electronic engraving. To date, typical prior art processes for obtaining such a satisfactory copper deposit must be so nearly chloride ion free that special reagents and de-ionized water are required for the make-up bath.

Applicants have determined that a finely grained laminar deposit, even though lacking the hardness generally believed to be necessary for electronic engraving, is highly suitable for use in such an engraving process. Achieving successful engraving at a lower degree of hardness is an advantage in that it reduces tool wear and prolongs the useful life of the apparatus. Applicants' laminar deposit is achieved through the use of a bath containing the usual sulfate and copper ions, but containing an additive whose ingredients are specifically identified and carefully balanced.

The copper plate developed from the bath of this invention is laminar in form and characterized by layers or crystal structure changes having an approximate thickness of 0.00005 inches which are readily visible under an optical microscope when the plate is sectioned and etched.

SUMMARY OF THE INVENTION

In one aspect, the present invention concerns a method of depositing on gravure rolls a layer of copper especially adapted to receive electronic engraving comprising the steps of placing a gravure roll in an electroplating bath comprising from about 150 to about 225 grams/liter of copper sulfate, from about 35 to about 90 grams/liter of sulfuric acid, from about 1 to about 15 grams/liter of a polyether having a molecular weight from about 4,000 to about 10,000, from about 0.3 to about 3.0 milligrams/liter of 1-lower alkyl-2-mercapto imidazole, and from about 1 to about 100 milligrams/liter of a sulfonated, sulfurized benzene compound; and passing electrical current through the bath to deposit copper on said roll.

In another aspect, the instant invention relates to an additive adapted for use to form a bath to electrodeposit a layer of copper especially adapted for electronic engraving of gravure rolls from a bath comprising from about 150 to about 225 grams/liter of copper sulfate, from about 35 to about 90 grams/liter of sulfuric acid, said additive consisting essentially of ingredients to provide from about 1 to about 15 grams/liter of a polyethylene oxide having a molecular weight ranging from 4,000 to about 10,000, from about 0.3 to about 3.0 milligrams/liter of 1-lower alkyl-2-mercapto imidazole, and from about 1 to about 100 milligrams/liter of sulfonated, sulfurized benzene compound.

DESCRIPTION OF THE PREFERRED PRACTICE OF THE INVENTION

The bath of this invention is formed by combining with a solution containing from about 150 to about 225 grams/liter of copper sulfate and from about 35 to about 90 grams/liter of sulfuric acid and a very small quantity of chloride ion, an additive consisting essentially of a polyether and a balanced quantity of 1-lower alkyl-2-mercapto imidazole and a sulfurized, sulfonated benzene compound.

The polyether is desirably a polyethylene oxide material having a molecular weight in the range of about 4,000 to 10,000 and preferably in the range of about 8,000. In the bath as little as about 1 gram/liter will be effective and a substantial excess of up to about 15 grams/liter may be employed. A preferred quantity is about 3 grams/liter. Suitable polyether compounds are disclosed in U.S. Pat. No. 3,328,273. These compounds can be illustrated by the following structural formula: $R\text{-}(CH_2CH_2O)_nH$, where $R{=}C_2H_5O\text{-}$, $HOC_2H_4O\text{—}$,

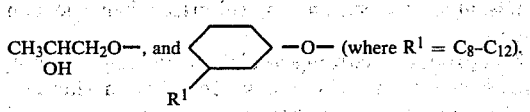

An ingredient for controlling grain structure in the copper deposit, which is an essential feature of this invention, is 1-lower alkyl-2 mercapto imidazole. The quantity in the bath may vary from about 0.3 milligrams/liter to about 3.0 milligrams/liter. A preferred amount in the bath is about 1 milligram/liter. As used herein, the term "lower alkyl" means alkyl groups having from one to four carbon atoms, such as methyl, ethyl, n-propyl, iso propyl, n-butyl, iso butyl, secondary butyl and tertiary butyl.

A brightener composition similar to that of a sulfonated, sulfurized benzene compound as discussed in U.S. Pat. No. 2,424,887 is employed in the bath in a range of more than about 1 milligram/liter to about 100 milligrams/liter. A preferred quantity is about 20 milligrams/liter.

The bath should contain from about 20 to about 80 ppm of chloride ion, preferably about 50 ppm.

The plating is applied to the roll with the plating bath at a temperature ranging from about 70° F. to about 80° F., preferably at about 75° F. Current may be from about 60 to about 200 A/sq. ft., preferably about 150 A/sq. ft. Plating is continued until the deposit is about 15 mils (0.015) inch thick. The deposit typically has a Rockwell T hardness of about 87 to about 91.

EXAMPLE I

A plating bath was prepared containing 1 milligram/liter of 1-methyl-2-mercapto imidazole, 2.4 milligrams/liter of benzene sulfate disulfide, 3 grams/liter Carbowax 8000, 210 grams/liter of copper sultate 60 grams/liter of sulfuric acid, and 50 ppm of chloride. A copper gravure roll was plated at 75° F. at 175 A/sq. ft. to produce a deposit, 0.015 in. thick, which had a Rockwell T hardness of 80. The deposit was sectioned and etched and found to have a plurality of distinct laminar markings approximately 0.00005 inches apart. The deposit on the drum was successfully engraved by the electronic method. In conformity with the standard procedure in the copper electroplating art, as used herein and in the appended claims the term "copper sulfate" is intended to mean copper sulfate pentahydrate ($CuSO_4.5H_2O$).

While there have been described what are at present considered to be the preferred embodiments of this invention, it will be obvious to those skilled in the art that various changes and modifications may be made therein without departing from the invention, and it is, therefore, intended in the appended claims to cover all such changes and modifications as fall within the true spirit and scope of the invention.

What is claimed is:

1. A method of depositing on gravure rolls a layer of copper especially adapted to receive electronic engraving comprising the steps of placing a gravure roll in an electroplating bath comprising from about 150 to about 225 grams/liter of copper sulfate, from about 35 to about 90 grams/liter of sulfuric acid, from about 1 to about 15 grams/liter of a polyether having a molecular weight from about 4,000 to about 10,000, from about 0.3 to about 3.0 milligrams/liter of 1-lower alkyl-2-mercapto imidazole, and from about 1 to about 100 milligrams/liter of a sulfonated, sulfurized benzene compound.

2. A process according to claim 1 wherein said polyether is present in an amount of about 3 grams/liter, said imidazole is present in an amount of about 1.0 milligram/liter, and said benzene compound is present in an amount of about 2.4 milligrams/liter.

3. A process according to claim 1 wherein a current of from about 30 to about 200 amperes/square foot is applied to the surface of the roll to deposit about 0.015 inch of copper thereon.

4. A process according to claim 3 wherein the bath is operated at a temperature in the range of from about 70 to about 80° F.

5. A process according to claim 1 wherein the bath contains from about 20 to about 80 ppm of chloride.

6. A process according to claim 1 wherein the polyether is polyethylene oxide.

7. A process according to claim 1 wherein the lower alkyl group is methyl.

8. A process according to claim 1 wherein the benzene compound is 2,2', dithio bis alkyl benzene sulfonic acid.

9. An additive to form a bath to electrodeposit a layer of copper especially adapted for electronic engraving of gravure rolls from a bath comprising from about 150 to about 225 grams/liter of copper sulfate, from about 35 to about 90 grams/liter of sulfuric acid, said additive consisting essentially of ingredients to provide from about 1 to about 15 grams/liter of a polyethylene oxide having a molecular weight ranging from 4,000 to about 10,000, from about 0.3 to about 3.0 milligrams/liter of 1-lower alkyl-2-mercapto imidazole, and from about 1 to about 100 milligrams/liter of sulfonated, sulfurized benzene compound.

10. The additive of claim 9 wherein said polyether is present in an amount of about 3 grams/liter, said imidazole is present in an amount of about 1.0 milligram/liter, and said benzene compound is present in an amount of about 2.4 milligrams/liter.

* * * * *